US009340973B2

(12) United States Patent
Carbary et al.

(10) Patent No.: US 9,340,973 B2
(45) Date of Patent: May 17, 2016

(54) ASSEMBLIES FOR A STRUCTURE

(75) Inventors: Lawrence Donald Carbary, Midland, MI (US); Charles Dunaway Clift, Dallas, TX (US)

(73) Assignees: DOW CORNING CORPORATION, Midland, MI (US); CURTAIN WALL DESIGN AND CONSULTING, INC., Dallas, TX (US)

( * ) Notice: Subject to any disclaimer, the term of this patent is extended or adjusted under 35 U.S.C. 154(b) by 0 days.

(21) Appl. No.: 13/981,835

(22) PCT Filed: Jan. 24, 2012

(86) PCT No.: PCT/US2012/022381

§ 371 (c)(1),
(2), (4) Date: Oct. 11, 2013

(87) PCT Pub. No.: WO2012/103102

PCT Pub. Date: Aug. 2, 2012

(65) Prior Publication Data

US 2014/0026502 A1 Jan. 30, 2014

Related U.S. Application Data

(60) Provisional application No. 61/436,521, filed on Jan. 26, 2011.

(51) Int. Cl.

| | |
|---|---|
| ***E04H 1/00*** | (2006.01) |
| ***E04B 2/90*** | (2006.01) |
| ***E06B 3/54*** | (2006.01) |

(52) U.S. Cl.

CPC ..... *E04B 2/90* (2013.01); *E06B 3/5427* (2013.01)

(58) Field of Classification Search

CPC ..... E04B 2/96; E04B 2/7457; E04B 2/90; E04B 2/88; E04B 2/885; E04B 2/965; E04B 3/5427; E04B 2/967

USPC ..... 52/483.1, 266, 235, 348, 510, 474, 52/475.1, 482, 774, 781.3, 786.1

See application file for complete search history.

(56) References Cited

U.S. PATENT DOCUMENTS 3,321,880 A * 5/1967 Ferrell et al. ..... 52/235
3,785,104 A * 1/1974 Dailen ..... 52/204.597

(Continued)

FOREIGN PATENT DOCUMENTS

CN 201627888 U 11/2010
CN 101949189 A 1/2011

(Continued)

OTHER PUBLICATIONS

English language abstract and machine-assisted English translation for CN 201627288 extracted from espacenet.com database on Apr. 27, 2015, 13 pages.

(Continued)

*Primary Examiner* — Brian Mattei
*Assistant Examiner* — Gisele Ford
(74) *Attorney, Agent, or Firm* — Howard & Howard Attorneys PLLC

(57) ABSTRACT

An assembly for a structure comprises a support and a panel. The panel may be a glass panel. The assembly further comprises a structural adhesive, which couples the panel to the support. The structural adhesive may comprise a silicone. The structural adhesive h a first coupling surface facing the support and a second coupling surface spaced from the first coupling surface and facing the interior surface of the panel. The structural adhesive has a substantially right-trapezoidal cross-section, which is oriented in a certain direction relative to the panel and the support. The first coupling surface is sloped relative to the second coupling surface of the structural adhesive thereby reducing stress in the assembly due to environmental load subjected on the structure, such as wind load.

Other supports and assemblies are also provided. The assembly may be used to form curtain walls, window walls, skylights, etc.

19 Claims, 9 Drawing Sheets

(56) References Cited

U.S. PATENT DOCUMENTS

| | | | | | |
|---|---|---|---|---|---|
| 4,418,506 | A | * | 12/1983 | Weber et al. | 52/209 |
| 4,650,702 | A | | 3/1987 | Whitmyer | |
| 4,691,489 | A | * | 9/1987 | Shea, Jr. | 522/35 |
| 4,756,132 | A | | 7/1988 | Newman | |
| 4,905,435 | A | * | 3/1990 | Horst | 52/235 |
| 5,076,034 | A | * | 12/1991 | Bandy | 52/235 |
| 5,199,236 | A | * | 4/1993 | Allen | 52/235 |
| 5,245,808 | A | * | 9/1993 | Grunewald et al. | 52/235 |
| 5,381,637 | A | * | 1/1995 | Farag | 52/204.595 |
| 5,592,795 | A | * | 1/1997 | Rinehart et al. | 52/235 |
| 6,550,196 | B2 | * | 4/2003 | Braybrook | 52/235 |
| 7,162,842 | B2 | * | 1/2007 | Ribic | 52/235 |
| 7,779,584 | B2 | * | 8/2010 | Arias | 52/235 |
| 7,832,160 | B2 | * | 11/2010 | Farag | 52/235 |
| 2002/0124499 | A1 | * | 9/2002 | Braybrook | 52/235 |
| 2005/0166496 | A1 | | 8/2005 | Farag | |
| 2011/0296775 | A1 | * | 12/2011 | Dolby et al. | 52/204.6 |

FOREIGN PATENT DOCUMENTS

| | | | |
|---|---|---|---|
| DE | 2058113 | A1 | 5/1972 |
| JP | S 62-42611 | U | 3/1987 |
| JP | 2007-177468 | A | 7/2007 |
| WO | WO 2004/089617 | A1 | 10/2004 |

OTHER PUBLICATIONS

English language abstract for CN 101949189 extracted from espacenet.com database on Apr. 27, 2015, 1 page.

English language abstract not available for DE 2058113; however, see Machine Assisted English Translation. Original document extracted from the espacenet.com database on Nov. 8, 2013, 33 pages.

International Search Report for Application No. PCT/US2012/022381 dated May 30, 2012, 3 pages.

English language translation for JPS 62-42611 provided by Multiling on Dec. 21, 2015, 8 pages.

English language abstract and machine-assisted English translation for JP 2007-177468 extracted from espacenet.com database on Nov. 16, 2015, 16 pages.

* cited by examiner

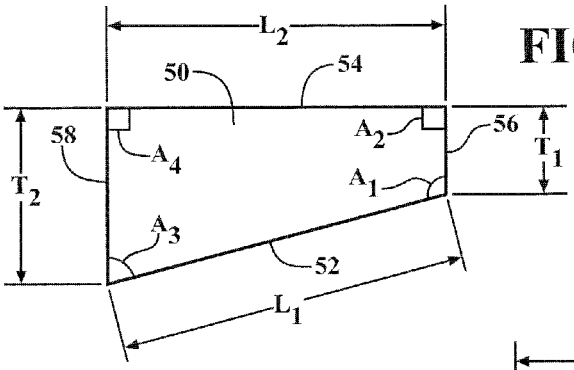
FIG. 9
FIG. 10
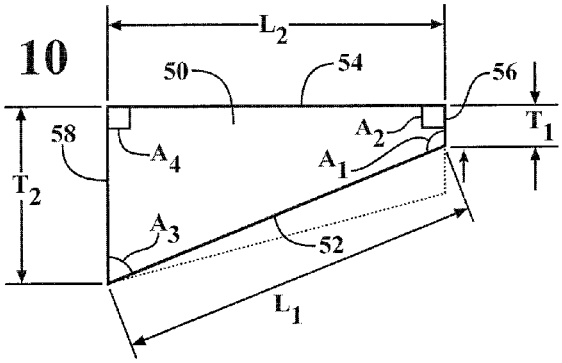
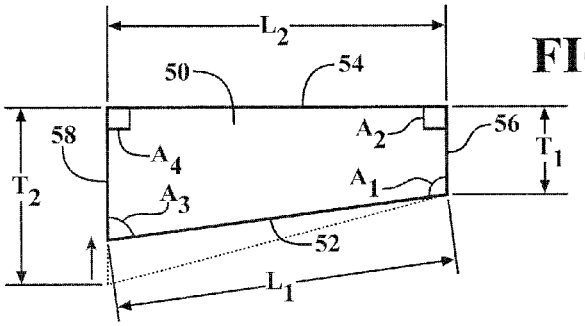
FIG. 11
FIG. 12
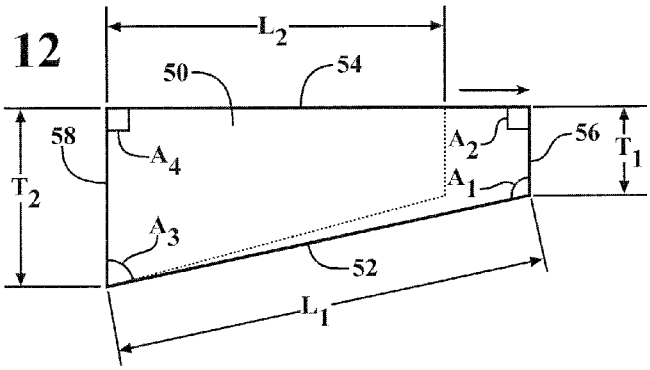

FIG. 16
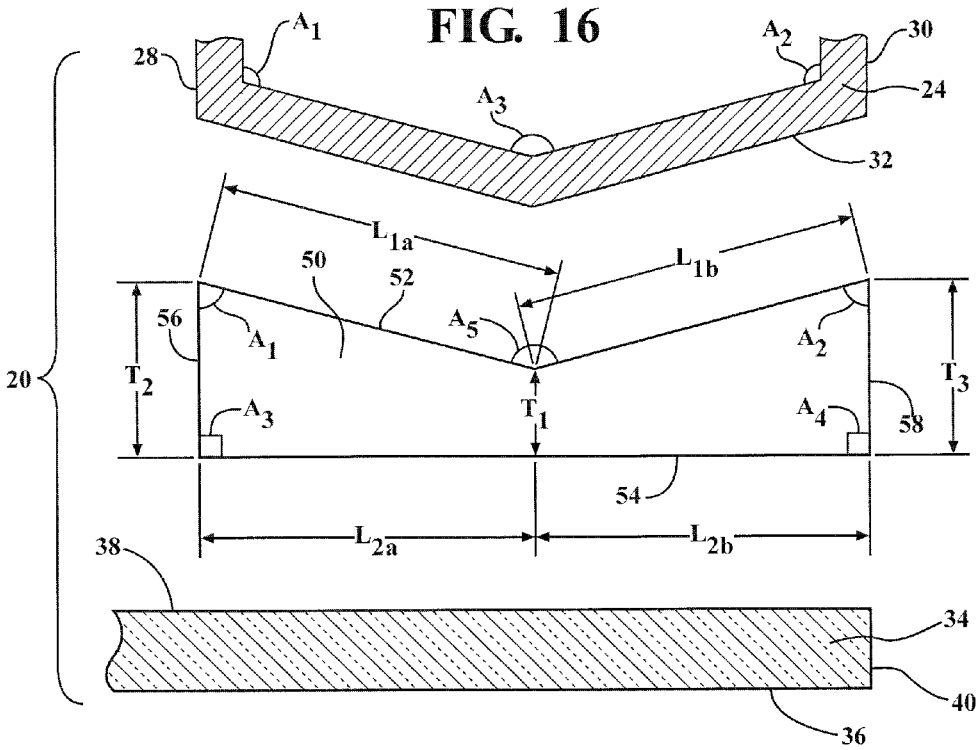
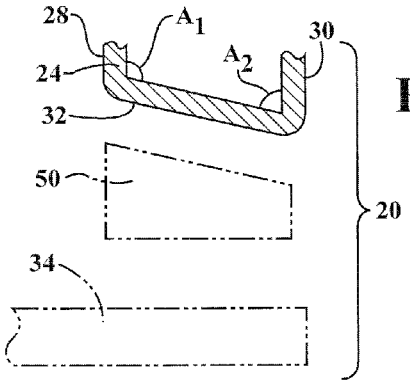
FIG. 17
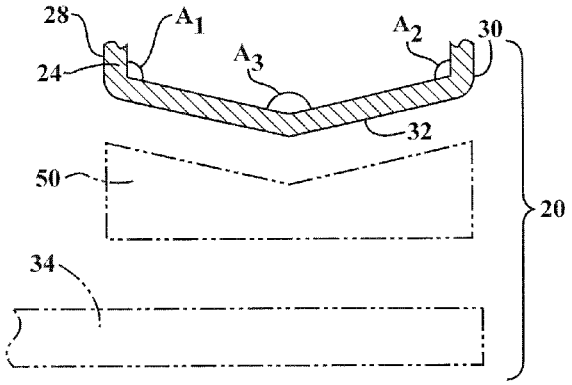
FIG. 18

ASSEMBLIES FOR A STRUCTURE

This application is the National Stage of International Patent Application No. PCT/US2012/022381, filed on Jan. 24, 2012, which claims the benefit of U.S. Provisional Patent Application Ser. No. 61/436,521, filed on Jan. 26, 2011, which is incorporated herewith in its entirety.

FIELD OF THE INVENTION

The present invention generally relates to an assembly for a structure subject to environmental load which causes stress in the assembly, and more specifically to an assembly comprising a support, a panel, and a structural adhesive having a specific cross-sectional shape which is disposed between the support and panel.

DESCRIPTION OF THE RELATED ART

A curtain wall (or glazing system) is an outer covering of a building comprising a plurality of an assembly (or unit). Each of the assemblies of the curtain wall has a panel or an "infill" disposed within and/or on an inner support made up of various frame-members including vertical mullions, a head, and a sill. When glass panels are used in the curtain wall, an advantage is that light can enter the building.

Conventional curtain walls are typically designed to resist air and water infiltration, sway induced by wind and seismic forces acting on the building, and dead load weight forces of the curtain wall. The curtain wall transfers horizontal wind loads that are incident upon it to the building through connections at floors or columns of the building. Such wind loads can be extremely high based on the design, height, and location of the building.

A two-sided glazing system is typically one in which the glass panel is conventionally glazed at opposite sides, i.e., mechanically retained with gaskets, but utilizes structural silicone to bond the glass panel to the perimeter framing on the remaining two sides (typically the mullions). The mechanically retained edges generally support the dead load of the glass panel. The live load of the glass panel is carried on the two edges with structural silicone. Dead load is generally considered the load due to mass of the components of the glazing system, while live load is considered the weight imposed by use and occupancy of the building, e.g. snow and wind. Two-sided glazing systems are not to be confused with butt-joint glazing which does not provide a structural bond to the inner support. Butt-joint glazing provides a weather seal only on two edges of the glass panel.

A four-sided glazing system is typically one in which structural silicone is used to bond the glass panel to perimeter framing on all sides. As such, the structural silicone acts as a continuous flexible anchor between the glass panel and the frame-members. Dead loads are supported either mechanically by a horizontal fin and/or by the structural silicone alone, depending on design of the glazing system. Four-sided glazing systems are sealed continuously around the glass panel perimeter, blocking air and water from entering the interior of the building. Typically, in either glazing system, the structural silicone has a substantially rectangular cross-section due to the shape of the glass panel and shape of the frame-members behind the glass panel.

"Structural bite" or "bite" is the minimum width or contact surface of the structural silicone on both the glass panel and the support. Typically, the building design wind load, glass panel dimensions, impact loads, dead load, and thermal dilation stresses must be considered in determination of the bite dimension. A typical bite to thickness ratio for a rectangular cross-section of structural adhesive is 1:1 to 3:1, with minimum bites of 6 mm and minimum thicknesses of 6 mm As such, the bite is typically larger than the thickness of the structural silicone. Thickness is considered the distance from the glass panel to the frame-member, i.e., the shortest side of the rectangular cross-section. Proper thickness facilitates installation of the structural silicone and allows reduced adhesive stress from differential thermal movement between the glass panel and the frame-member.

The bite requirement is directly proportional to the wind load on the building and the dimensions of the glass panel. Two of the controlling variables which affect the bite requirement are the maximum short span dimension of the glass panel and the design wind load that the glazing system must be designed to accommodate. Typically, the higher the wind load and the larger the short span dimension of the glass panel is, the greater the amount of bite required.

Unfortunately, in some building designs as well as in some building locations, high wind loads prohibit the use of assemblies having structural silicone due to the size of the bite required to maintain adhesion between the glass panel and the frame-members. This problem is compounded by requiring larger frame-members to accommodate the larger bite of the structural silicone. Increasing the size of the bite, and therefore, the size of the frame-members, not only reduces the amount of light that can pass through the curtain wall, but also detracts from the aesthetic quality of the curtain wall. For example, in a building design having 5 ft (~1.5 m) wide glass panels, with 200 lb/ft$^2$ (PSF; ~9.6 kPa) wind loads acting on the building, e.g. in Florida, a rectangular cross-section of structural silicone would require a bite of at least 2 in (~5 cm) and a thickness of at least ¼ in (~0.5 cm). This 2 in bite of structural silicone requires an even greater sized frame-member behind it, both of which detract from the lighting and aesthetic qualities of the curtain wall.

In addition, based on the high wind loads, the structural silicone has high internal stresses due to the glass panel bowing in and out relative to the framework as wind hits and deflects off of the curtain wall. Over time, these internal stresses can cause fatigue and/or failure of the structural adhesive, which is especially problematic in four-sided glazing systems where no other means typically retain the glass panels. In addition, in the event that the glass panel breaks, such as during a hurricane, the remaining glass pieces will bow in and out many more times and to a higher degree during the hurricane. This greatly decreases the time before failure of the structural silicone such that the glass pieces will break free from the structural silicone potentially causing further damage to persons or property.

As such, there remains an opportunity to provide assemblies having improved properties, such as reduced stress when subject to environmental load. There also remains an opportunity to provide assemblies with improved lighting and aesthetics.

SUMMARY OF THE INVENTION AND ADVANTAGES

The subject invention provides an assembly for a structure. The structure may be subject to an environmental load, which causes stress in the assembly. The assembly comprises a support and a panel. The panel has an exterior surface and an interior surface spaced from the exterior surface. A surrounding edge is between the exterior and interior surfaces. The interior surface of the panel faces and is coupled to the support. A cavity is defined between the interior surface of the panel and the support. The assembly further comprises a structural adhesive disposed in the cavity for coupling the panel to the support. The structural adhesive has a first coupling surface facing the support. The structural adhesive also has a second coupling surface spaced from the first coupling surface and facing the interior surface of the panel. An outer peripheral surface is between the coupling surfaces of the structural adhesive.

The outer peripheral surface of the structural adhesive is disposed adjacent the surrounding edge of the panel. An inner peripheral surface of the structural adhesive is between the coupling surfaces. The inner peripheral surface is spaced from the outer peripheral surface inwardly along the panel relative to the outer peripheral surface. The coupling surfaces and the peripheral surfaces define a substantially right-trapezoidal cross-section of the structural adhesive. The outer peripheral surface has a thickness (T1) extending away from the interior surface of the panel toward the support. The inner peripheral surface has a thickness (T2) also extending away from the interior surface of the panel toward the support. T2 of the inner peripheral surface is greater than T1 of the outer peripheral surface. The first coupling surface is sloped relative to the second coupling surface of the structural adhesive thereby reducing stress in the assembly due to the environmental load subjected on the structure. Other supports and assemblies are also provided.

The assemblies have reduced stress relative to conventional assemblies when the structure is subject to environmental load. The assemblies also have improved lighting and aesthetics, and can be used in various locations and building designs, while providing various benefits such as an air seal, water seal, and/or thermal barrier for the structure.

BRIEF DESCRIPTION OF THE DRAWINGS

The present invention may be readily appreciated, as the same becomes better understood by reference to the following detailed description when considered in connection with the accompanying drawings wherein:

FIGS. 9 through 15 are transverse cross-sectional views of different embodiments of invention structural adhesives having substantially right-trapezoidal cross-sections with varying thicknesses, lengths, and angles;

FIG. 16 is an exploded transverse cross-sectional view of another embodiment of the assembly with the structural adhesive having a substantially concave-polygonal cross-section;

FIG. 17 is an exploded transverse cross-sectional view of a support with the panel and structure adhesive in phantom; and FIG. 18 is an exploded transverse cross-sectional view of another embodiment of the support with the panel and structure adhesive in phantom.

DETAILED DESCRIPTION OF THE INVENTION

With reference to the Figures, wherein like numerals indicate corresponding parts throughout the several views, an assembly (or unit) is generally shown at 20.

Figure 1:
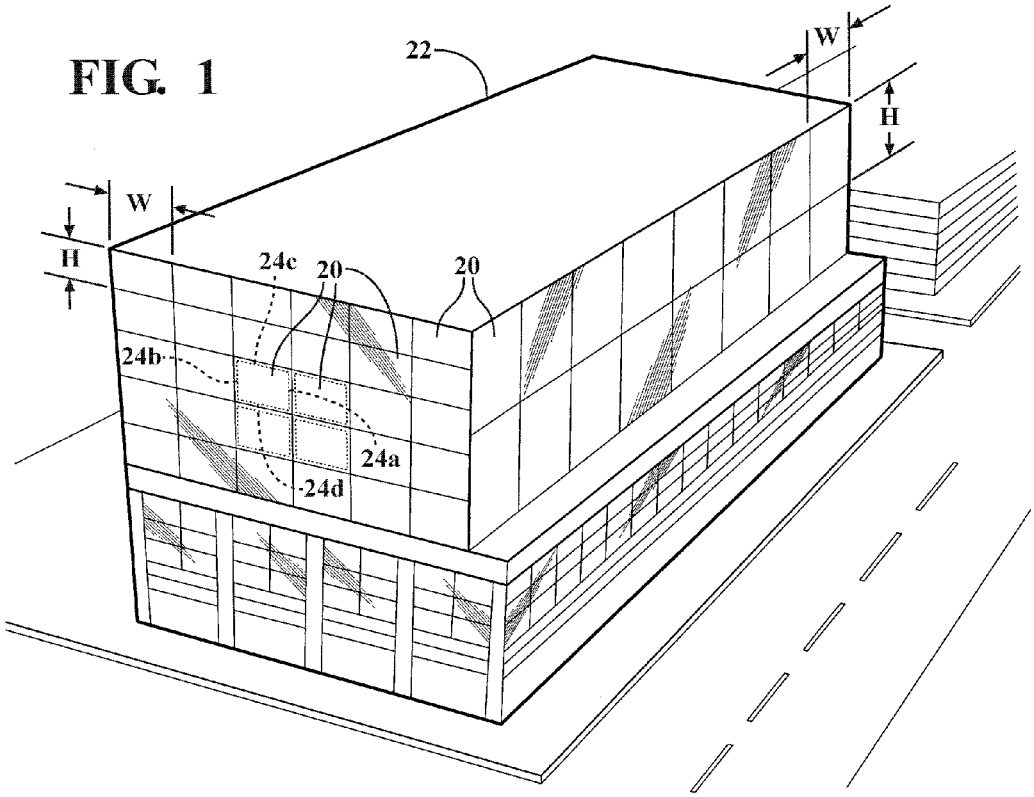
FIG. 1 is a perspective view of a structure including a plurality of an embodiment of the assembly in a side-by-side configuration forming a curtain wall of a structure.

Referring to FIG. 1, a plurality of the assembly 20 is shown coupled to a structure 22. The assemblies 20 are arranged in a side-by-side configuration. The assemblies 20 can be in line with one another, as shown, or offset with respect to one another (not shown). The assemblies 20 are typically modular such that they are substantial duplicates of one another. However, the structure 22 may include assemblies 20 that are different then each other, such as assemblies 20 of different size, shape, and/or configuration. For example, as shown in FIG. 1, the assemblies 20 on one side of the structure 22 are smaller than the assemblies 20 on another side of the structure 22.

The configuration of assemblies 20 shown in FIG. 1 can be referred to in the art as a curtain wall, more specifically as a four-sided curtain wall or as a four-sided glazing system. In this configuration, the curtain wall presents a substantially smooth and continuous exterior surface of the structure 22. The assembly 20 can also be implemented as a two-sided curtain wall or as a two-sided glazing system, which typically has a less smooth appearance relative to a four-sided glazing system. Examples of other types of applications suitable for the assembly 20 include stick systems, unitized systems, window wall applications, and skylights (not shown). Further examples include spandrel applications, e.g. non vision applications, including glass, ceramic, stone, composite, or metal spandrel applications. Glazing is another term commonly used for glass. Reference to "two-sided" and "four-sided" is not in reference to the structure 22, rather, is in reference to the configuration of the assembly 20.

Curtain walls can be used for various structures 22, such as for commercial buildings, industrial buildings, residential buildings, etc. These buildings can be low-rise, mid-rise, or high-rise. Curtain walls can provide various benefits to the structures 22, including providing light, view, climate control, weather protection, and aesthetics. Curtain walls typically do not carry roof or floor loads, and are generally hung from the columns or face or top of floor slabs of the structure 22. As such, curtain walls are typically considered in the art to be non-structural and/or non-load bearing.

Curtain walls can represent an entire skin (or exterior façcade) of the structure 22, or just a portion thereof. In contrast, window walls are generally oriented in a different location with respect to the structure 22, such that the exterior façcade of the structure 22 also includes faces of floor slabs and/or columns For example, a window wall will typically extend from the top of one floor to the underside of a floor below, and/or in long horizontal strips around the structure 22. As such, the window wall will generally be set back into the structure 22, e.g. between floors, rather than being set out as a continuous outer skin of the structure 22. As such, the assemblies 20 may actually span less than one storey, one storey, or more than one storey of the structure 22. While the assembly 20 is described as being useful for forming curtain walls and window walls of structures 22, the assembly 20 is not limited to any particular application.

Figure 3:
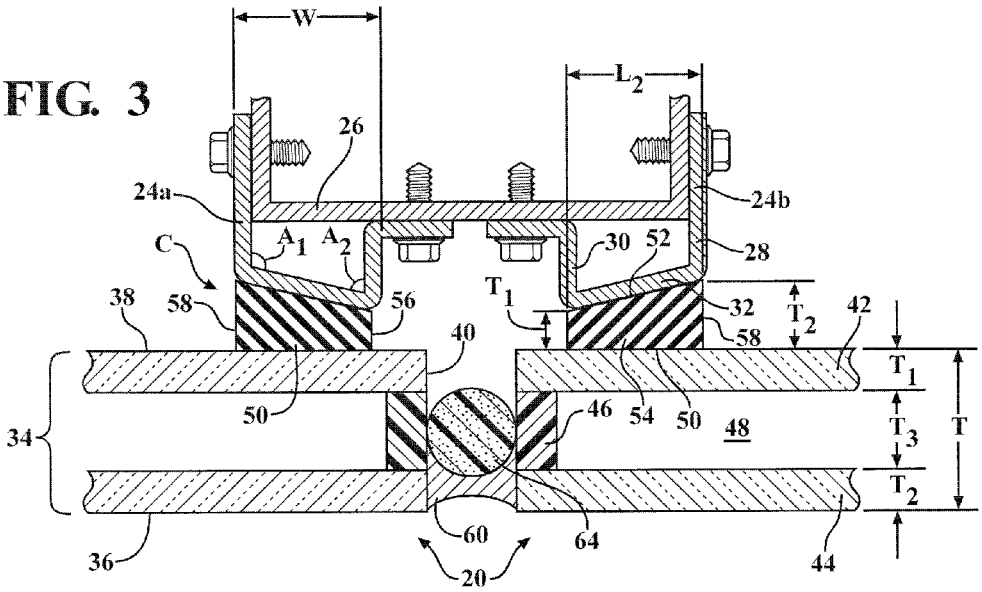
FIG. 3 is a transverse cross-sectional view of a portion of another curtain wall having another embodiment of two assemblies with each of the assemblies having a support mechanically connected to a supplemental support.
Figure 4:
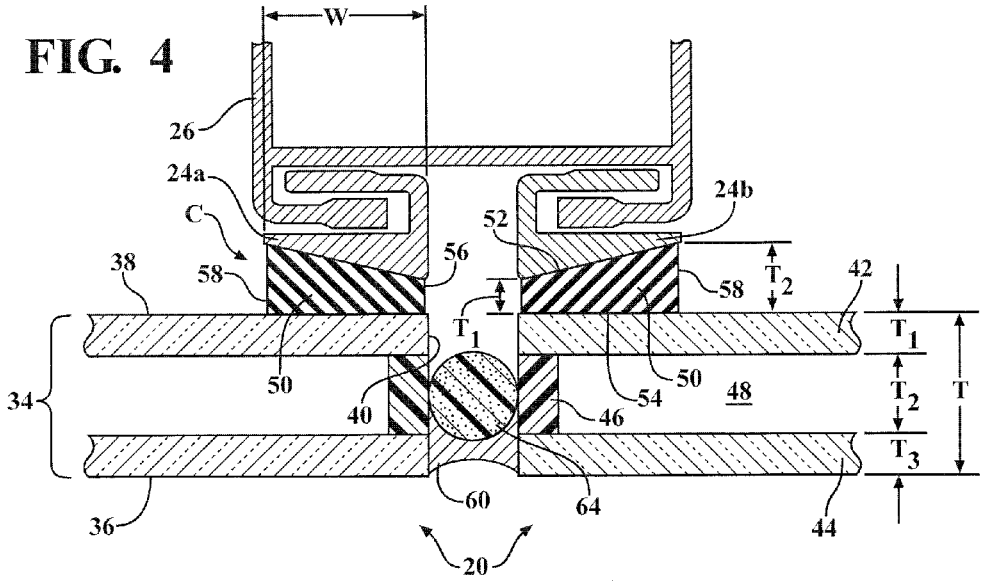
FIG. 4 is similar to FIG. 3 with another embodiment of the assemblies having supports slidably connected to a supplemental support.
Figure 5:
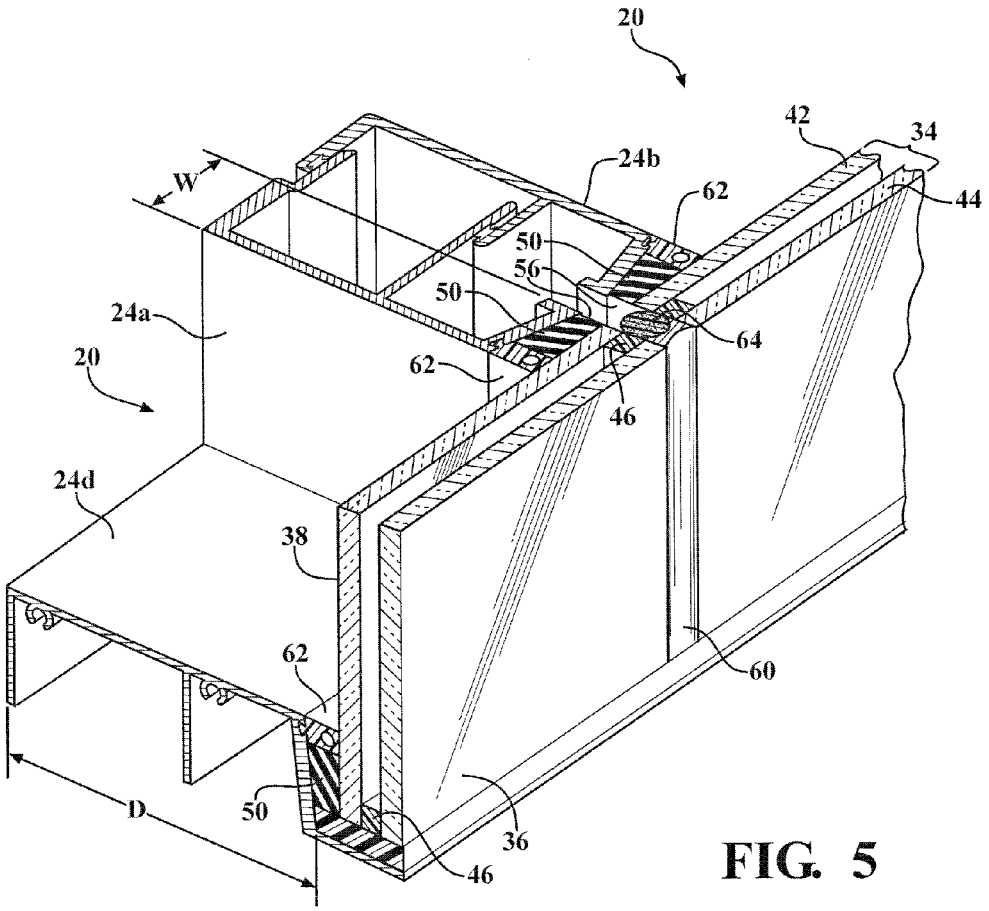
FIG. 5 is a perspective cutaway view of a curtain wall having another embodiment of two assemblies each having a sill and a mullion in a four-sided glazing system.
Figure 6:
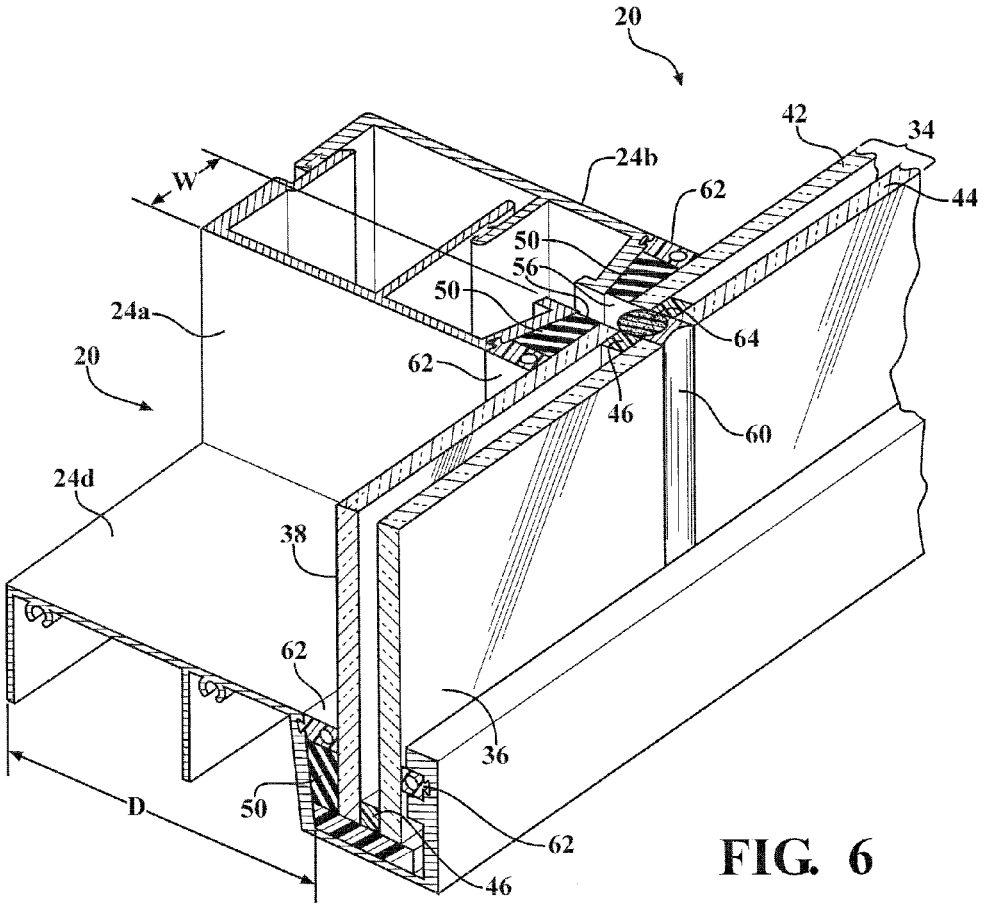
FIG. 6 is a perspective cutaway view of a curtain wall having another embodiment of two assemblies each having a sill and a mullion in a two-sided glazing system.

Referring to FIGS. 2 through 6, two assemblies 20 are generally shown in a curtain wall configuration, with a right-side portion of one assembly 20 and a left-side portion of another assembly 20. The left and right sides of the assemblies 20 are generally mirror images of each other, which is described in greater detail below. The same is generally true for the upper and lower sides of the assemblies 20. However, in certain applications, one or more of the sides of the assemblies 20 may be different than the others, based on what the assembly 20 is intended for or on location of the assembly 20 within or on the structure 22. This is generally the case with two-sided systems, where the upper and lower sides of the assemblies 20, i.e., a head and a sill, are different than the left and right sides of the assemblies 20, i.e., left and right mullions. An example of a lower right and lower left corner of two assemblies 20 in a two-sided glazing system is depicted in FIG. 6. In contrast, in four-sided systems, all four sides of the assemblies 20 are generally the same. An example of a lower right and lower left corner of two assemblies 20 in a four-sided glazing system is depicted in FIG. 5.

The assembly 20 comprises a support 24. The support 24 can be of various sizes, shapes, and configurations. As shown in FIGS. 2 through 6, various configurations of supports 24 are shown. The support 24 can be a preexisting part of the structure 22, e.g. a beam, or more typically, part of the assembly 20 which attaches to the structure 22, such as by attaching the support 24 to the top or face of a floor slab of the structure 22. Depending on application, the assembly 20 can be fabricated in a production facility and erected at the jobsite, which is generally the case with four-sided glazing systems, and/or fabricated directly on the jobsite, which is generally the case with two-sided glazing systems (although two-sided glazing systems can also be fabricated offsite and erected onsite). The assembly 20 is not limited to any particular type of manufacturing process.

The support 24 is typically a frame-member 24. As such, the support 24 may be a jamb 24, which is generally a vertical frame-member 24 of the assembly 20. The support 24 may also be a head 24 or a sill 24, which is generally a horizontal frame-member 24 of the assembly 20. Such frame-members 24 can also be referred to in the art as mullions, transoms, or rails. Depending on configuration of the assembly 20, the support 24 can also be angled relative to the structure 22, e.g. in a skylight or roofing application. The support 24 can comprise a unitary frame-member 24 forming an entire periphery of the assembly 20, or be a plurality of two or more joined frame-members 24 around the entire periphery of the assembly 20 or a portion thereof.

The assembly 20 can be of various shapes as introduced above, typically in a quadrilateral shape, and more typically in a rectangular shape. For example, as shown in FIG. 1, each of the assemblies 20 include four supports 24 (in phantom), with some of the assemblies 20 in a rectangular configuration and some of the assemblies 20 in a square configuration.

In one embodiment, the support 24 is further defined as a first support 24*a* and a second support 24*b* spaced from the first support 24*a*. The support 24 is yet further defined as a third support 24*c* extending between the first and second supports 24*a*, 24*b* and a forth support 24*d* extending between the first and second supports 24*a*, 24*b* and spaced from the third support 24*c*. A quadrilateral configuration is defined by the first, second, third, and fourth supports 24*a*, 24*b*, 24*c*, 24*d*. As introduced above, the support(s) 24 can be frame-members 24. For example, the first support 24*a* can be a right jamb 24*a*, the second support 24*b* can be a left jamb 24*b*, the third support 24*c* can be a head 24*c*, and the fourth support 24*d* can be a sill 24*d* of the assembly 20.

The support 24 can be of various lengths (or heights), widths W and depths D. It is useful to minimize the width W of the support 24 to increase lighting of the assembly 20. As width W of the support 24 is increased, light passage through the assembly 20 generally decreases. Minimizing width W of the support 24 can also be aesthetically pleasing. The support 24 typically has a width W of from about ½ to about 6, about ⅞ to about 3, or about 15/16 to about 2, inches (in); alternatively from about 1.25 to about 15, about 2 to about 8, or about 2.5 to about 5, cm. Strength of the support 24, and therefore, the assembly 20, is generally controlled by the depth D of the support 24 rather than by the width W of the support 24. As such, depth D of the support 24 can be tailored based on application of the assembly 20.

Figure 2:
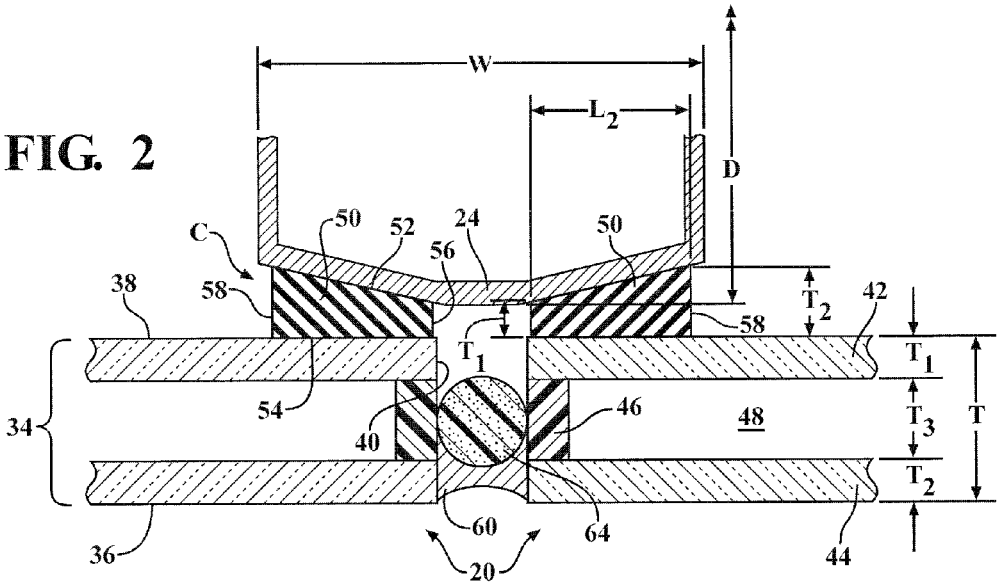
FIG. 2 is a transverse cross-sectional view of a portion of a curtain wall having two assemblies sharing a support.

As introduced above, the support 24 can be of various configurations and shapes, depending on application of the assembly 20. For example, as shown in FIG. 2, the support 24 has a C-shaped cross-section and retains two separate assemblies 20 in a side-by-side configuration. As shown in FIG. 3, two supports 24 are shown mechanically fastened to a supplemental support 26. The support 24 has an inner wall 28 and an outer wall 30 spaced from the inner wall 28 with a coupling edge 32 extending between the walls 28,30. An obtuse angle A1 is defined between the coupling edge 32 and the inner wall 28 and an acute angle A2 is defined between the coupling edge 32 and the outer wall 30. The walls 28,30 can be of various thicknesses, such as about ⅛ in (~0.3 cm) or greater. FIG. 17 shows a support 24 similar to the support 24 of FIG. 3. The walls 28,30 may be of substantial thickness such that the support 24 is not hollow as shown in the Figures. A1,A2 of the support 24 may vary in degree, provided they are substantially still within the range of degrees by name, e.g. A1 is between 9020 and 180° and A2 is less than 90°.

FIG. 4 shows a similar situation as shown in FIG. 3, but with differently shaped supports 24 and supplemental support 26. In this configuration, the assemblies 20 can be slid into place on the supplemental support 26. The supports 24, and if present, the supplemental support 26, can be of various sizes, shapes, and configurations depending on the desired structure 22, and such configurations are nearly limitless.

FIGS. 16 and 18 shows another type of support 24 for another embodiment. The support 24 is similar to the other supports 24, such as the support 24 of FIG. 3, but has a different shaped coupling edge 32. Specifically, the coupling edge 32 extends between the walls 28,30 and has a first portion and a second portion adjacent the first portion. The first portion is adjacent the inner wall 28 and the second portion is adjacent the outer wall 30. The first and second portions are generally complimentarily shaped relative to a structural adhesive 50 (or vice-versa). As shown, the coupling edge 32 is generally convex in shape or pointed. In another embodiment (not shown), the coupling edge 32 further has a third portion between the first and second portions. The third portion can be substantially parallel relative to the interior surface 38 of the panel 34 or slightly sloped. For example, the coupling edge 32 of the support 34 can have a partial isosceles cross-section defined by the first, second and third portions. If present, the third portion is also generally complimentarily shaped relative to the structural adhesive 50 (or vice-versa). The coupling edge 32 is adjacent the surrounding edge 40 of the panel 34 such that the cavity C is defined between the interior surface 38 of the panel 34 and the support 24. The coupling edge 32 of the support 24 may be defined by two or more separate supports 24, provided the coupling edges 32 define the shapes as described herein, i.e., the coupling edges 32 are sloped and/or convex. The structural adhesive 50 is described further below.

Referring further to FIGS. 16 and 18, an obtuse angle A3 is defined between the first and second portions of the coupling edge 32, another obtuse angle A1 is defined between the first portion of the coupling edge 32 and the inner wall 28, and yet another obtuse angle A2 is defined between the second portion of the coupling edge 32 and the outer wall 30. A1,A2, A3 of the support 24 may vary in degree, provided they are substantially still within the range of degrees by name, e.g. A1 is between 90° and 180°. Lengths of the first and second portions of the coupling edge 32, and third portion if present, can be the same or vary. In one embodiment, the first and second portions have substantially the same length, such that A1,A2 are substantially the same.

The support 24 can be formed from various materials, typically from a rigid material such as a metal, polymer, or composite. Typically, the support 24 is formed from a metal or a metal alloy, such as aluminum or steel. Aluminum offers an advantage of being able to be easily extruded into nearly any shape required for design and aesthetic purposes of the support 24. As such, the supports 24 can be extruded aluminum frame-members 24 of various sizes and shapes.

Optionally, the support 24 may be primed or painted with a coating composition for corrosion protection and/or increased adhesion. An example of such a coating composition is Alodine®, which is commercially available from various chemical suppliers. If utilized, Alodine® is useful for increasing adhesion strength between the support 24 and the structural adhesive 50.

The assembly 20 further comprises a panel 34, which can also be referred to in the art as an infill 34 or lite 34. The panel 34 has an exterior surface 36 and an interior surface 38 spaced from the exterior surface 36. A surrounding edge 40 is between the surfaces 36,38. The interior surface 38 of the panel 34 faces and is coupled to the support 24, with a cavity C defined between the interior surface 38 of the panel 34 and the support 24. The cavity C has a substantially right-trapezoidal cross-section.

The panel 34 typically extends between and over the supports 24. In certain embodiments, such as in a four-sided glazing system, the exterior surface 36 of the panel 34 is free of the supports 24. Such embodiments are generally shown in FIGS. 1 through 5. In other embodiments, such as in a two-sided glazing system, the exterior surface 36 of the panel is retained by at least one of the supports 24, typically by two of the supports 24, such as by the head 24*c* and the sill 24*d* of the assembly 20. Such an embodiment is generally shown in FIG. 6. The support 24 is typically close to the surrounding edge 40 of the panel 34 to increase lighting and aesthetics of the assembly 20; however, the support 24 may also be set back from the surrounding edge 40. Typically, the coupling edge 32 of the support 24 is sloped relative to interior surface 38 of the panel 34. The interior surface 38 of the panel 34 generally faces inward of the structure 22, such as into a room or stairwell.

The panel 34 may be formed from various materials, such as glass, stone, metal, plastic, etc. The panel 34 may also include functional elements, such as louvers, windows, vents, etc. Typically, as like shown in the Figures, the panel 34 is formed from glass such that the panel 34 is a glass panel 34 or glazing 34. The panel 34 can be single-pane or double-pane. As shown in FIGS. 2 through 6, the panel 34 includes an inner pane 42 and an outer pane 44. The panes 42,44 are bonded to opposite sides of a seal 46. The seal 46 can be formed from various materials, and may include one or more pieces, such as a first sealant and a second sealant. Suitable materials for the seal 46 include, but are not limited to, polyisobutylene and silicone. An air gap 48 is defined within the panel 34 for insulation purposes.

The panes 42,44 are typically formed from tempered glass to prevent breakage of the panel 34; however, other types of glass can also be used. The panel 34 can also be laminated glass 34 or composite 34, such as panes 42,44 of tempered glass with an inner layer sandwiched between the panes 42,44. The inner layer can formed from a polymeric material, such as ionoplast resin. Such composites 34 can also be referred to in the art as safety glass 34.

The panel 34 can be of various sizes and shapes. Typically, the panel 34 is quadrilateral in shape, more typically, rectangular in shape. However, the panel 34 can be in other shapes, such as a trapezoid, a circle, or a triangle. The panel 34 typically has a width W of from about 1 foot to about 15 feet (ft), about 3 to about 10, or about 4 to about 7, ft; alternatively from about 0.25 to about 4.75, about 1 to about 3, or about 1.2 to about 2, m. The panel 34 typically has a height H of from about 1 to about 20, about 5 to about 15, or about 5 to about 7, ft; alternatively from about 0.25 to about 6, about 1.5 to about 4.75, or about 1.5 to about 2, m. As described above, the assembly 20 may span a portion of a storey, a storey, or more than one storey of the structure 22.

Typically the panel 34 is planar with a substantially uniform thickness T. The panel 34 typically has a thickness T of from about ⅛ to about 8, about ¼ to about 4, or about ⅜ to about 1, in; alternatively from about 0.3 to about 20, about 0.6 to about 10, or about 1 to about 2.5, cm. As described above, the panel 34 may be single pane 42 or double pane glass 42,44 (if not more), or other materials as described above, e.g. metal. As such, T above may refer to a single pane 42, a combination of panes 42,44, or T of an insulating spandrel panel 34. Each of the panes 42,44 may be the same T as each other, or different than each other. If the panel 34 is a composite 34, such as the three layered composite 34 described above, two or more of the layers may have the same T, or the layers may each be of different T. In a specific embodiment, the panes 42,44 each have a thickness T1,T2 of about 3/16 in (~0.5 cm), and the air gap 48 (or inner layer of polymeric material) has a thickness T3 of about 1/10 in (~0.25 cm). T1,T2,T3 can each also be larger or smaller in size.

The assembly 20 further comprises the structural adhesive 50 (hereinafter adhesive 50), as introduced above. The adhesive 50 is disposed in the cavity C for coupling the panel 34 to the support 24. As best shown in FIG. 2, the adhesive 50 is typically shaped complementary to the cavity C. The adhesive 50 can also be referred to in the art as an adhesive bead 50 or an adhesive joint 50. However, the adhesive 50 is different than a conventional gasket or wedge, which do not adhere the panel 34 to the support 24. Typically, gaskets and wedges merely mechanically engage the panel 34 and the support 24, whereas the adhesive 50 adheres the panel 34 to the support 24.

The adhesive 50 has a first coupling surface 52 facing the support 24. The adhesive 50 also has a second coupling surface 54 spaced from the first coupling surface 52 and facing the interior surface 38 of the panel 34. An outer peripheral surface 56 is between the coupling surfaces 52,54. The outer peripheral surface 56 is disposed adjacent the surrounding edge 40 of the panel 34. An inner peripheral surface 58 is between the coupling surfaces 52,54 and spaced from the outer peripheral surface 56 inwardly along the panel 34 relative to the outer peripheral surface 40.

The coupling surfaces 52,54 and the peripheral surfaces 56,58 define a substantially right-trapezoidal cross-section. The outer peripheral surface 56 has a thickness T1 extending away from the interior surface 38 of the panel 34 toward the support 24. The inner peripheral surface 58 has a thickness T2 also extending away from the interior surface 38 of the panel 34 toward the support 24. T2 of the inner peripheral surface 58 is greater than T1 of the outer peripheral surface 56. As such, the first coupling surface 52 is sloped relative to the second coupling surface 54.

T1 of the outer peripheral surface 56 of the adhesive 50 is typically of from about ¼ to about 1, about ¼ to about ¾, or about ¼to about ½, in; alternatively from about 0.6 to about 2.5, about 0.6 to about 2, or about 0.6 to about 1.3, cm. T2 of the inner peripheral surface 58 of the adhesive 50 is greater than T1 of the outer peripheral surface 56. T2 of the inner peripheral surface 58 of the adhesive 50 is typically of from about 5/16 to about 2, about ½ to about 1, or about ½ to about ¾, in; alternatively from about 0.8 to about 5, about 1.3 to about 2.5, or about 1.3 to about 2, cm.

The second coupling surface 54 of the adhesive 50 has a length L2. The first coupling surface 52 of the adhesive 50 has a length L1 greater than L2 of the second coupling surface 54. Typically, L2 of the second coupling surface 54 of the adhesive 50 is no greater than about 2, about ½ to about 2, about ¾ to about 2, or about 15/16 to about 1, in; alternatively no greater than about 5, from about 1.3 to about 5, about 2 to about 5, or about 2.3 to about 2.5, cm. L1 of the first coupling surface 52 of the adhesive 50 can be determined by T1,T2 and the Pythagorean Theorem. The adhesive 50 can have various combinations T1,T2 and L1,L2 as exemplified in FIGS. 9 through 15, provided that the substantially right-trapezoidal cross-section of the adhesive 50 is maintained.

L2 of the second coupling surface 54 of the adhesive 50 can also be referred to in the art as "bite" L2 or as "structural bite" L2. On a related note, "glass bite" may refer to the amount of glass panel 32 obstructed by the support 24 and the adhesive 50. As described above, it is often useful to increase the amount of light able to pass through the assembly 20, such that the bites are minimized to the extent possible while still maintaining structural integrity of the assembly 20. For example, once in place, e.g. in a curtain wall, the assembly 20 must withstand certain environment loads, e.g. wind loads, which are described below.

One or more of the surfaces 52,54,56,58 of the adhesive 50 may have some irregularities such that the surface 52,54,56, 58 is not completely planar as shown in the Figures. For example, one of the peripheral surfaces 56,58 may be slightly concave or convex due to placement, and/or expansion or contraction of the adhesive 50. In addition, one of coupling surfaces 52,54 may be concave or convex depending on the shape of the support 24 and/or the panel 34, typically, the shape of the support 24. The coupling edge 32 of the support 24 is generally complimentary to the first coupling surface 52. For example, the support 24 may be formed to include a substantially planar, concave, or convex coupling edge 32, which will define the shape of the cavity C, and therefore, the shape of the adhesive 50. As shown in the Figures, the coupling edge 32 is typically substantially planar; however, changes in the shape of the coupling edge 32 of the support 24 may also occur, and such changes may even further reduce stress in the adhesive 50, as described below. As described above, extrusion can be used to form the support 24. As such, the support 24 may be formed via extrusion through a die having a planar, concave, and/or convex portion defining the coupling edge 32 of the resulting support 24.

As best shown in FIGS. 2 through 4 and 9 through 15, the first coupling surface 52 and the outer peripheral surface 56 of the adhesive 50 define an obtuse angle A1 of the substantially right-trapezoidal cross-section. The second coupling surface 54 and the outer peripheral surface 56 of the adhesive 50 define a right angle A2 of the substantially right-trapezoidal cross-section. The first coupling surface 52 and the inner peripheral surface 58 of the adhesive 50 define an acute angle A3 of the substantially right-trapezoidal cross-section. The second coupling surface 54 and the inner peripheral surface 58 of the adhesive 50 define another right angle A4 of the substantially right-trapezoidal cross-section.

A right-trapezoid is a trapezoid having two right angles. A1,A2,A3,A4 may vary in degree, provided they are substantially still within the range of degrees by name, e.g. A1 is between 90° and 180° and A3 is less than 90° . A2, A4 may not be exact. Said another way, A2,A4 be slightly higher or lower than 90°, e.g. 90±5 or fewer degrees.

FIGS. 16 and 18 illustrate another embodiment of the adhesive 50. The adhesive 50 is similar to the structural adhesives of the other Figures, but has a different cross-section. As best shown in FIG. 16, the first coupling surface 52 faces the support 24 and has a first portion and a second portion adjacent the first portion. An obtuse angle AS is defined between the first and second portions. The outer peripheral surface 58 is disposed adjacent the surrounding edge 40 of the panel 34 and the second portion of the first coupling surface 52. The inner peripheral surface 56 is spaced from the outer peripheral surface 58 inwardly along the panel 34 relative to the outer peripheral surface 58 and adjacent the first portion of the first coupling surface 52. The coupling surfaces 52,54 and the peripheral surfaces 56,58 define a substantially concave-polygonal cross-section. The cross-section may also be referred to as a partial-bowtie cross-section. The adhesive 50 has a thickness T1 extending away from the interior surface 38 of the panel 34 toward the support 24 between the first and second portions of the first coupling surface 52. T1 is adjacent A5. The inner peripheral surface 56 has a thickness T2 also extending away from the interior surface 38 of the panel 34 toward the support 24. The outer peripheral surface 58 has a thickness T3 yet also extending away from the interior surface 38 of the panel 24 toward the support 24. T1 of the adhesive 50 is less than both of T2,T3 of the peripheral surfaces 56,58 such that the first coupling surface 52 is concave relative to the second coupling surface 54.

As best shown in FIG. 16, the first portion of the first coupling surface 52 and the inner peripheral surface 56 of the adhesive 50 define an acute angle Al of the substantially concave-polygonal cross-section. The second portion of the first coupling surface 52 and the outer peripheral surface 58 of the adhesive 50 define another acute angle A2 of the substantially concave-polygonal cross-section. The second coupling surface 54 and the inner peripheral surface 56 of the adhesive 50 define a right angle A3 of the substantially concave-polygonal cross-section. The second coupling surface 54 and the outer peripheral surface 58 of the adhesive 50 define another right angle A4 of the substantially concave-polygonal cross-section.

Referring further to FIG. 16, T2 of the inner peripheral surface 56 and T3 of the outer peripheral surface 58 are substantially equal. In other embodiments, T2,T3 may be different, such as T3 being smaller than T2, or vice-versa. As also shown in FIG. 16, the second coupling surface 54 has a first portion and a second portion, each having a length L2*a*, L2*b*, respectively. L2*a*,2*b* may be the same as or different than each other. The first coupling surface 52 also has a length L1, with the first portion having a length L1*a* and the second portion having a length L2*b*. L1*a*,L1*b* may be the same as or different than each other. As shown, the first coupling surface 52 is generally concave in shape. In another embodiment (not shown), the first coupling surface 52 further has a third portion between the first and second portions. The third portion can be substantially parallel relative to the second coupling surface 54 or slightly sloped. For example, the first coupling surface 52 of the adhesive 50 can have a partial isosceles cross-section defined by the first, second and third portions. If present, the third portion is also generally complimentarily shaped relative to the support 24 (or vice-versa). A1,A2,A3, A4,A5 of the adhesive 50 may vary in degree, provided they are substantially still within the range of degrees by name, e.g. AS is between 90° and 180°. In one embodiment, the first and second portions have substantially the same L1*a*,L2*b*, such that A1,A2 are substantially the same.

As best shown in FIGS. 2 through 4, the structure 24 typically abuts along at least a majority of the first coupling surface 52 of the adhesive 50. The interior surface 38 of the panel 34 typically abuts along at least a majority of the second coupling surface 54 of the adhesive 50. The coupling edge 32 of the support 24 typically abuts the first coupling surface 52 of the adhesive 50. Increasing contact between the adhesive 50 and the panel 34 and the support 24 generally increases adhesion strength between the support 24 and the panel 34 of the assembly 20.

The adhesive 50 can comprise various adhesives. Typically, the adhesive 50 comprises a silicone, which can be formed from a one- or two-part system. As such, the adhesive 50 can also be referred to in the art as structural silicone. Suitable adhesive systems are commercially available from Dow Corning Corporation of Midland, Mich., such as Dow Corning® 983—Silicone Glazing and Curtainwall Adhesive/Sealant or —Silicone Structural Sealant. Further examples include Dow Corning® 995—Silicone Structural Sealant, Dow Corning® 993—Structural Sealant, and Dow Corning® 895—Structural Glazing Sealant. Such adhesives are typically different than other adhesives or sealants, which can be used as weather stripping 60 between or within the assemblies 20. Such sealant systems are also commercially available from Dow Corning Corp., such as Dow Corning® 795—Silicone Building Sealant and/or Dow Corning® 791—Weatherproofing Sealant.

While not necessarily shown in the Figures, the assembly 20 can have additional components. For example, the assembly 20 may further include weather stripping 60, gaskets 62, backing tapes, setting blocks, backing rods 64, and spacers. Backing tapes or gaskets 62 are often used to back the cavity C during application of the adhesive 50. The adhesive 50 may be applied into the cavity C via conventional caulking techniques. Backing rods 64 are often used to back voids when applying weather stripping 60. While gaskets 62 are shown in FIGS. 5 and 6, one or more of the gaskets can be absent or replaced by a backing tape. In addition, while not generally shown in the Figures, backing tape or a similar component may be disposed on the cavity C on one or both peripheral surfaces 56,58 of the adhesive 50.

Figure 7:
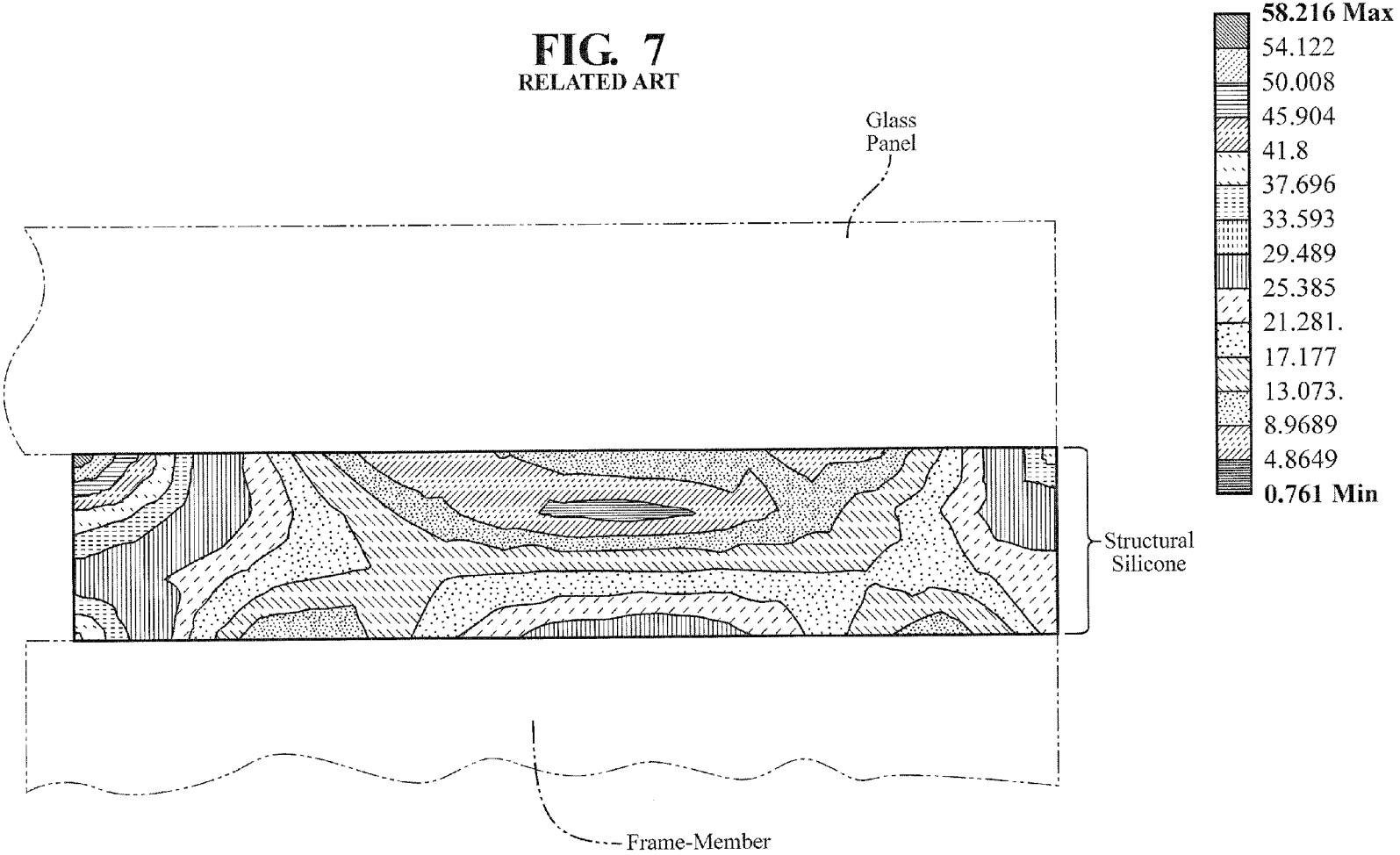
FIG. 7 RELATED ART
FIG. 7 is a transverse cross-sectional view of a related art structural adhesive having a substantially rectangular cross-section disposed between a panel and a support in phantom illustrating internal stress of the structural adhesive in pounds per square inch (psi) while under load according to finite element analysis (FEA), with a peak stress of about 59 psi (~407 kPa)

Referring now to FIG. 7, a conventional structural silicone having a substantially rectangular cross-section is shown. Such structural silicones are often present in conventional assemblies due to the configuration of such assemblies, which often include many right angles with respect to supports and panels. For example, many supports are parallel to the panels such that rectangular cavities are defined between the panel and the supports of the assembly. In some building designs, as well as in some building locations, environmental loads prohibit the use of such assemblies having this type of structural silicone or other structural silicones due to the size of the bite required to maintain adhesion between the glass panel and the support. This problem is compounded by requiring larger supports to accommodate the larger bite of the structural silicone. Increasing the size of the bite, and therefore, the size of the supports, not only reduces the amount of light that can pass through the assembly, but also detracts from the aesthetic quality of the assembly. For example, in a building design having 5 ft (~1.5 m) wide glass panels, with 200 PSF (~9.6 kPa) wind loads acting on the building, e.g. in Florida, a rectangular cross-section of structural silicone would require a bite of at least 2 in (~5 cm) and a thickness of at least ¼ in (~0.6 cm). This 2 in bite of structural silicone requires an even greater sized support behind it, both of which detract from the lighting and aesthetic qualities of the curtain wall including the conventional assemblies.

In addition, based on the high wind loads, the structural silicone having the rectangular cross-section has high internal stresses due to the glass panel bowing in and out relative to the support as wind hits and deflects off of the glass panel. These stresses are indicated by the various cross-hatches shown in FIG. 7, with a peak stress of about 59 psi (~407 kPa). The stresses are determined according to FEA using ANSYS to model the structural silicone as a hyperelastic material. The panel is 5 ft by 7¼ ft (~1.5 m by 2.2 m). The structural silicone has a 2 in (~5 cm) bite and a 20 psi (~138 kPa) design. The 20 psi design is generally considered the allowable design stress value or industry standard.

Under a 200 PSF (~9.6 kPa) wind load, the panel rotates (or bows) inwardly and outwardly relative to the support. The structural silicone acts as a pivot point such that the structural silicone is pinched and stretched between the panel and the support.

Stress on the perimeter of the panel under wind load will behave in a trapezoidal manner according to the theory of plate behavior under uniform loading. Other sizes of structural silicone having rectangular cross-sections were also calculated, with a 1.33 in (~3.4 cm) bite, (30 psi/~207 kPa design) having a peak stress of about 47 psi (~324 kPa), and a 15/16 in (~1 cm) bite, (44 psi/~303 kPa design) having a peak stress of about 50 psi (~345 kPa).

Over time, these internal stresses can cause fatigue and/or failure of the structural silicone, e.g. cohesive and/or adhesive failure. As can be seen in FIG. 7, the stresses are not uniform, but sporadic throughout cross-section of structural silicone. In the event that the glass panel breaks, such as during a hurricane, the remaining glass pieces will bow in and out many more times and to a higher degree during the hurricane. This greatly decreases the time before failure of the structural silicone such that the glass pieces will break free from the structural silicone potentially causing further damage to persons or property.

Figure 8:
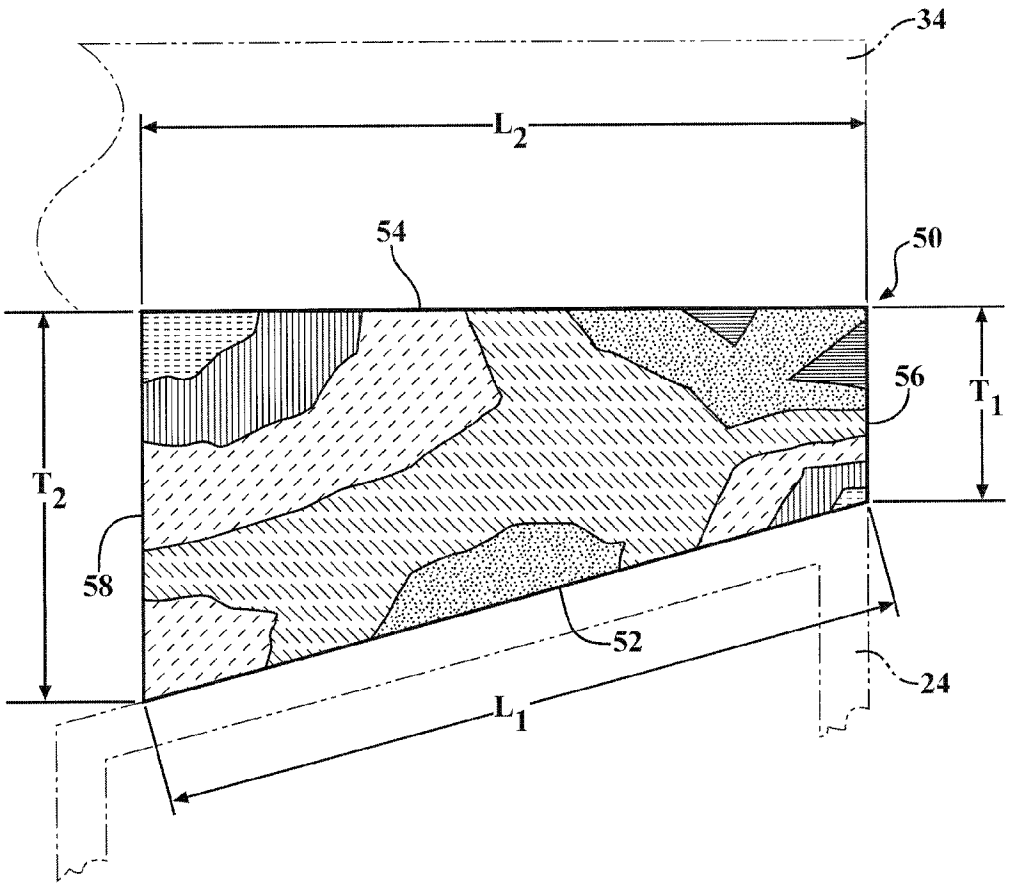
FIG. 8 is a transverse cross-sectional view of an embodiment of invention structural adhesive having a substantially right-trapezoidal cross-section disposed between a panel and a support in phantom illustrating internal stress of the structural adhesive in psi while under load according to FEA, with a peak stress of about 39 psi (~269 kPa)
Figure 8:
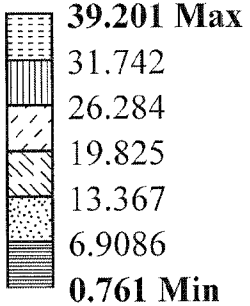
Figure 13:
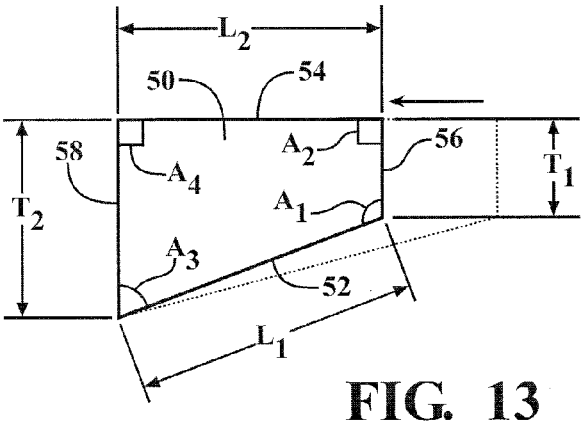
Figure 14:
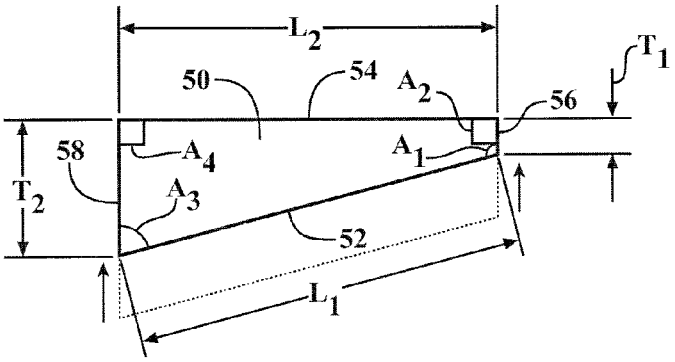
Figure 15:
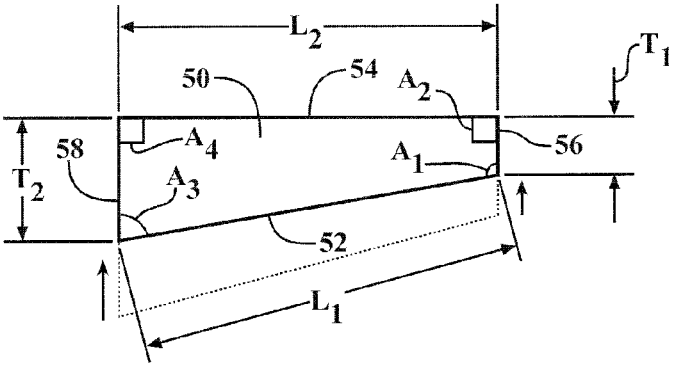

In FIG. 8, one embodiment of the adhesive 50 is shown. The adhesive 50 has a bite L2 of 15/16 in (~1 cm), a thickness T1 of ¼ in (~0.6 cm), and a thickness T2 of ½ in (~1.3 cm). The adhesive 50 was calculated in the same manner as described above for the structural silicone of FIG. 7. Surprisingly, the peak stress of the adhesive 50 was about 39 psi (~269 kPa) relative to the structural silicone shown in FIG. 7 having a peak stress of about 59 psi, which is a ~33% reduction. The peak stress of the adhesive 50 is also well below the other samples calculated which have rectangular cross-sections, including the one having an equivalent bite of 15/16 in but having a peak stress of about 50 psi (or ~28% higher).

Without being bound of limited by any particular theory, it is believed that the substantially right-trapezoidal cross-section of the adhesive 50 provides for reduced stress in the assembly 20 relative to conventional assemblies having structural silicones of rectangular cross-sections. In addition, it is also believed that the orientation of the substantially right-trapezoidal cross-section of the adhesive 50 provides for reduced stress in the assembly 20 relative to conventional assemblies. For example, it is believed that T1 being less than T2 of the adhesive 50 provides for reduced stress relative to the opposite scenario where T2 would be less than T1. It is believed that this orientation and specific cross-section is important because it is thought that the adhesive 50 can act as a hinge between the panel 34 and the support 24 when the panel 34 is subject to wind load.

It is believed that the substantially concave-polygonal cross-section of the other embodiment of the adhesive 50 with also have similar benefits as the substantially right-trapezoidal cross-section embodiment. For example, it is believed that this orientation and specific cross-section is important because it is thought that the adhesive 50 can act as a double hinge between the panel 34 and the support 24 when the panel 34 is subject to wind load.

Based on these findings and further hypotheses, the adhesive 50 thereby reduces stress in the assembly 20 due to the environmental load subjected on the structure 22. Typically, the environmental load of most concern to the structure 22, on a daily basis, is wind load as described above. For example, the assemblies 20 may be subject to maximum negative wind loads of about 200 PSF (~9.6 kPa), which will attempt to pull out the panel 34 from the structure 22, and positive wind loads of about 130 PSF (~6.2 kPa), which will attempt to push the panel 34 into the structure 22. However, other environmental loads may also come into play, such as seismic load, snow load, thermal load, and/or blast load. It is also believed that the assembly 20 will also have reduced stress when subject to these other types of environmental loads. Environmental loads are not equivalent to dead load, which is the generally load imparted by the components of the assembly 20.

The assembly 20 is generally configured to pass building codes. Typically, the assembly 20 passes at least one of the following two building code requirements: 1) Florida State building code according to protocols TAS-201, TAS-202, and TAS-203; or 2) Miami-Dade County building code according to protocols PA-201, PA-202, and PA-203. Miami-Dade County building codes are generally considered to be more stringent than Florida State building codes. The assembly 20 can be configured to pass other building codes in other locations as well, such as those required in Broward County, Fla.

Certain locations of structures 22 have strict building code requirements. For example, locations such as Florida tend to have hurricanes, which include high velocity winds, and therefore, high wind loads which affect structures 22. With such high winds comes the chance of blown debris (or projectiles) impacting the structure 22. As such, TAS-201 relates to procedures for conducting impact testing. TAS-202 relates to procedures for conducting uniform static air pressure testing. TAS-203 relates to procedures for conducting cyclic wind pressure loading testing.

PA-201, 202, and 203 are similar to the Florida State TAS protocols, but are for Miami-Dade County, Fla. Miami-Dade County building code generally requires that every exterior opening, residential or commercial, be provided with protection against wind-borne debris caused by hurricanes. Such protection includes impact-resistant products. There are two types of impact resistant products: large-missile resistant and small-missile resistant. To test for large-missiles, a product, e.g. the assembly 20, is exposed to various impacts with a piece of lumber weighing approximately 9 lbs, measuring 2 by 4 in by 9 ft (~5 by 10 cm by 2.7 m) in size, traveling at a speed of 50 ft/sec (~55 km/h). Next, the product is subjected to hurricane loading of 9,000 wind cycles, positive and negative (or +/−4,500 cycles).

To test for small-missile resistance, a product has been exposed to various impacts with 10 ball bearings traveling at a speed of 80 ft/sec (~88 km/h). The product is then subjected to wind loads for 9,000 cycles. Typically, the assemblies 20 are at least large missile compliant, which is generally more stringent a standard relative to small missile compliance.

The following examples, illustrating the assemblies of the present invention, are intended to illustrate and not to limit the invention.

EXAMPLES

First and second invention assemblies are made to test various physical properties. Each of the assemblies includes a panel structurally glazed to a support, specifically to an anodized aluminum frame, and are configured as four-sided glazing systems. The structural adhesive comprises silicone and has a 15/16 inch (~0.8 cm) bite, and more specifically has the same dimensions and orientation as described above with description of FIG. 8.

The structural adhesive is commercially available from Dow Coming and exceeds the minimum requirements of ETAG 002—"Guideline for European Technical Approval for Structural Sealant Glazing Systems (SSGS)", and ASTM C1184—"Standard Specification for Structural Silicone Sealants". The structural adhesive has properties measured according to ASTM C1135—"Standard Test Method for Determining Tensile Adhesion Properties of Structural Sealants". These properties are measured in triplicate and are detailed in Table I below.

TABLE I

| Example No. | | 1 | 2 | 3 | Mean | Std. Dev. |
|---|---|---|---|---|---|---|
| Length | in | 2 | 2 | 2 | 2 | 0 |
| Thickness | in | 0.5 | 0.5 | 0.5 | 0.5 | 0 |
| Peak Stress | psi | 157.1 | 161.2 | 142.4 | 153.5 | 9.9 |
| % Strain At Peak | % | 116.608 | 131.171 | 110.246 | 119.342 | 10.727 |
| Stress @ 10% Strain | psi | 36.896 | 34.483 | 37.952 | 36.444 | 1.778 |
| Stress @ 25% Strain | psi | 64.756 | 60.979 | 64.778 | 63.504 | 2.187 |
| Stress @ 50% Strain | psi | 98.417 | 93.019 | 97.822 | 96.419 | 2.96 |
| Stress @ 100% Strain | psi | 147.152 | 141.289 | 141.919 | 143.453 | 3.219 |
| Elongation at Peak | in | 0.583 | 0.656 | 0.551 | 0.597 | 0.054 |
| Peak Load | lbf | 157.056 | 161.197 | 142.397 | 153.55 | 9.878 |

Each of the panels includes interior and exterior panes of clear tempered glass. Each of the panes is 60 in by 75 in (152.4 cm by ~190.5 cm), and have an average thickness of 3/16 in (~0.48 cm). An interlayer is sandwiched between the panes. The interlayer has an average thickness of about 0.090 in (~0.23 cm). In the first assembly, the interlayer comprises polyvinyl butyral (PVB). In the second assembly, the interlayer comprises Dupont™ SentryGlas® Plus (SGP).

Each assembly is tested for air infiltration, water infiltration and structural performance according to the following ASTM Standards: ASTM E330—"Standard Test Method for Structural Performance of Exterior Windows, Doors, Skylights and Curtain Walls by Uniform Static Air Pressure Difference"; and ASTM E331—"Standard Test Method for Water Penetration of Exterior Windows, Skylights, Doors, and Curtain Walls by Uniform Static Air Pressure Difference".

Air infiltration for each assembly is measured at both 1.57 and 6.24 PSI' (~75 and ~300 Pa). No measureable air infiltration is detected in either assembly. Water infiltration for each assembly is tested for 15 minutes at 6.24 PSE (~300 Pa). No appreciable water infiltration is detected. Structural performance for each assembly is tested at ±150 PST, ±200 PSE and ±300 PST (~7.2 kPa, ~9.6 kPa, and ~14.4 kPa). No failure of the panel, structural adhesive, or support is detected in either assembly. Each assembly passes industry standards for performance with regards to air infiltration, water infiltration and structural integrity.

A third invention assembly is made, which is the same as the second assembly but includes panes of clear heat strengthened glass, Each of the panes has an average thickness of ¼ in (~0.635 cm). The assembly is tested according to ASTM E330 and ASTM E331 as described above. The assembly is also tested according to ASTM E1886—"Standard Test Method for Performance of Exterior Windows, Curtain Walls, Doors, and Impact Protective Systems Impacted by Missile(s) and Exposed to Cyclic Pressure Differentials". No failure of the panel, structural adhesive, or support is detected in the assembly. The assembly passes industry standards for performance with regards to air infiltration, water infiltration, structural integrity, and impact performance. FIG. 8 illustrates properties of the structural adhesive as described above.

One or more of the values described above may vary by ±5%, ±10%, ±15%, ±20%, ±25%, etc. so long as the variance remains within the scope of the disclosure. Unexpected results may be obtained from each member of a Markush group independent from all other members. Each member may be relied upon individually and or in combination and provides adequate support for specific embodiments within the scope of the appended claims. The subject matter of all combinations of independent and dependent claims, both singly and multiply dependent, is herein expressly contemplated. The disclosure is illustrative including words of description rather than of limitation. Many modifications and variations of the present disclosure are possible in light of the above teachings, and the disclosure may be practiced otherwise than as specifically described herein.

What is claimed is:

1. An assembly for a structure subject to an environmental load which causes stress in said assembly, said assembly comprising:

i) a support;

ii) a panel having an exterior surface and an interior surface spaced from said exterior surface with a surrounding edge between said exterior and interior surfaces, wherein said interior surface of said panel faces and is coupled to said support, with a cavity defined between said interior surface of said panel and said support; and iii) a structural adhesive disposed in said cavity for coupling said panel to said support, said structural adhesive having a first coupling surface facing said support and having a length (L1), a second coupling surface spaced from said first coupling surface and facing said interior surface of said panel and having a length (L2), wherein said length (L1) of said first coupling surface is greater than said length (L2) of said second coupling surface, an outer peripheral surface between said first and second coupling surfaces and disposed adjacent said surrounding edge of said panel, and an inner peripheral surface between said first and second coupling surfaces and spaced from said outer peripheral surface inwardly along said panel relative to said outer peripheral surface, wherein said first and second coupling surfaces and said outer and inner peripheral surfaces define a substantially right-trapezoidal cross-section, and wherein said outer peripheral surface has a thickness (T1) extending away from said interior surface of said panel toward said support, and said inner peripheral surface has a thickness (T2) also extending away from the interior surface of said panel toward said support, with T2 of said inner peripheral surface being greater than T1 of said outer peripheral surface such that said first coupling surface is sloped relative to said second coupling surface, thereby reducing peak stress of said structural adhesive in said assembly due to the environmental load subjected on the structure as compared to structural adhesives of the same composition having the same length (L1) and outer peripheral thickness (T1) but having a substantially rectangular cross-section, wherein said thickness (T1) of said outer peripheral surface ranges from ¼ inch to 1 inch and wherein said thickness (T2) of said inner peripheral surface ranges from 5/16 inch to 2 inches.

2. The assembly as set forth in claim 1 wherein said structure abuts along at least a majority of said first coupling surface of said structural adhesive and said interior surface of said panel abuts along at least a majority of said second coupling surface of said structural adhesive.

3. The assembly as set forth in claim 1 wherein said exterior surface of said panel is free of said support.

4. The assembly as set forth in claim 1 wherein said support has an inner wall and an outer wall spaced from said inner wall with a coupling edge extending between said inner and outer walls such that an obtuse angle is defined between said coupling edge and said inner wall and an acute angle is defined between said coupling edge and said outer wall with said coupling edge abutting said first coupling surface of said structural adhesive.

5. The assembly as set forth in claim 1 wherein said support is an extruded frame-member selected from the group of a jamb, a head, a sill, or a combination thereof.

6. The assembly as set forth in claim 1 passing at least one of the following two building code requirements:

1) Florida State building code according to protocols TAS-201, TAS-202, and TAS-203; or 2) Miami-Dade County building code according to protocols PA-201. PA-202, and PA-203.

7. The assembly as set forth in claim 1 wherein said first coupling surface and said outer peripheral surface of said structural adhesive define an obtuse angle of said substantially right-trapezoidal cross-section, said second coupling surface and said outer peripheral surface of said structural adhesive define a right angle of said substantially right-trapezoidal cross-section, said first coupling surface and said inner peripheral surface of said structural adhesive define an acute angle of said substantially tight-trapezoidal cross-section, and said second coupling surface and said inner peripheral surface of said structural adhesive define another right angle of said substantially right-trapezoidal cross-section.

8. The assembly as set forth in claim 1 wherein:

i) said structural adhesive comprises a silicone;

ii) said panel is a glass panel; or iii) both i) and ii).

9. An assembly for a structure subject to an environmental load which causes stress in said assembly, said assembly comprising:

i) a first support and a second support spaced from said first support;

ii) a panel having an exterior surface and an interior surface spaced from said exterior surface with a surrounding edge between said exterior and interior surfaces, said panel extending over each of said first and second supports, wherein said interior surface of said panel faces and is coupled to each of said first and second supports, with a cavity defined between said interior surface of said panel and said first support and a cavity defined between said interior surface of said panel and said second support; and iii) a structural adhesive disposed in each of said cavities for coupling said panel to said first and second supports, each one of said structural adhesives having a first coupling surface facing each of said first and second supports, each respective one of said first coupling surfaces having a length (L1), a second coupling surface spaced from said first coupling surface and facing said interior surface of said panel, each respective one of said second coupling surfaces having a length (L2), wherein said length (L1) of said first coupling surface associated with said first support is greater than said length (L2) of said second coupling surface associated with said first support and wherein said length (L1) of said first coupling surface associated with said second support is greater than said length (L2) of said second coupling surface associated with said support support, an outer peripheral surface between each pair of said respective first and second coupling surfaces and disposed adjacent said surrounding edge of said panel, and an inner peripheral surface between each pair of said respective first and second coupling surfaces and spaced from said outer peripheral surface inwardly along said panel relative to said outer peripheral surface, wherein said first and second coupling surfaces and said outer and inner peripheral surfaces of each one of said structural adhesives define a substantially right-trapezoidal cross-section, and wherein said outer peripheral surface of each one of said structural adhesives has a thickness (T1) extending away from said interior surface of said panel toward each of said first and second supports, and said inner peripheral surface of each one of said structural adhesives has a thickness (T2) also extending away from the interior surface of said panel toward each of said first and second supports, with T2 of said inner peripheral surface of each one of said structural adhesives being greater than T1 of said outer peripheral surface of said respective one of said structural adhesives such that said first coupling surface is sloped relative to said second coupling surface, thereby reducing peak stress of each respective one of said structural adhesives in said assembly due to the environmental load subjected on the structure as compared to a corresponding structural adhesive of the same composition having the same length (L1) and outer peripheral thickness (T1) but having a substantially rectangular cross-section, wherein said first coupling surface and said outer peripheral surface of said structural adhesive define an obtuse angle of said substantially right-trapezoidal cross-section said second coupling surface and said outer peripheral surface of said structural adhesive define a right angle of said substantially &lit-trapezoidal cross-section, said first coupling surface and said inner peripheral surface of said structural adhesive define an acute angle of said substantially right-trapezoidal cross-section, and said second coupling surface and said inner peripheral surface of said structural adhesive define another right angle of said substantially right- trapezoidal cross-section.

10. The assembly as set forth in claim 9 wherein said exterior surface of said panel is free of said first and second supports.

11. The assembly as set forth in claim 9 further comprising a third support extending between said first and second supports and a fourth support extending between said first and second supports and spaced from said third support, with a quadrilateral configuration defined by said first, second, third, and fourth supports.

12. The assembly as set forth in claim 11 wherein said panel also extends over each of said third and fourth supports, said interior surface of said panel facing and also coupled to each of said third and fourth supports, with a cavity defined between said interior surface of said panel and said third support and a cavity defined between said interior surface of said panel and said fourth support.

13. The assembly as set forth in claim 12 wherein said structural adhesive is also disposed in each of said cavities for also coupling said panel to said third and fourth supports.

14. The assembly as set forth in claim 11 wherein said exterior surface of said panel is free of said first, second, third, and fourth supports.

15. The assembly as set forth in claim 11 wherein each of said first, second, third, and fourth supports abut along at least a majority of said first coupling surface of said structural adhesive and said interior surface of said panel abuts along at least a majority of said second coupling surface of said structural adhesive.

16. The assembly as set forth in claim 9 wherein each of said first and second supports abut along at least a majority of said first coupling surface of a respective one of said structural adhesives and said interior surface of said panel abuts along at least a majority of said second coupling surface of said respective one of said structural adhesives.

17. The assembly as set forth in claim 9 wherein:

i) said structural adhesive comprises a silicone;

ii) said panel is a glass panel; or iii) both i) and ii).

18. An assembly for a structure subject to an environmental load which causes stress in said assembly, said assembly comprising:

i) a support;

a panel having an exterior surface and an interior surface spaced from said exterior surface with a surrounding edge between said exterior and interior surfaces, wherein said interior surface of said panel faces and is coupled to said support, with a cavity defined between said interior surface of said panel and said support; and iii) a structural adhesive disposed in said cavity for coupling said panel to said support, said structural adhesive having a first coupling surface facing said support and having a first portion and a second portion adjacent said first portion with an obtuse angle defined between said first and second portions, wherein said first portion of said first coupling surface has a length (L1*a*) and wherein said second portion of said first coupling surface has a length (L1*b*), wherein (L1*a*) and (L1*b*) are the same or different, said length (L1*a*) and said length (L1*b*) defining a length (L1), a second coupling surface spaced from said first coupling surface and facing said interior surface of said panel and having a first portion and a second portion adjacent said first portion, wherein said first portion of said second coupling surface having a length (L2*a*) and said second portion of said second coupling surface having a length (L2*b*), wherein (L2*a*) and (L2*b*) are the same or different, said length (L2*a*) and said length (L2*b*) defining a length (L2)

wherein said length (L1*a*) greater than said length (L2*a*) and wherein said length (L1*b*) is greater than said length (L2*b*), an outer peripheral surface between said first and second coupling surfaces and disposed adjacent said surrounding edge of said panel and said second portion of said first coupling surface, and an inner peripheral surface between said first and second coupling surfaces and spaced from said outer peripheral surface inwardly along said panel relative to said outer peripheral surface and adjacent said first portion of said first coupling surface, wherein said first and second coupling surfaces and said outer and inner peripheral surfaces define a substantially concave-polygonal cross-section, and wherein said structural adhesive has a thickness (T1) extending away from said interior surface of said panel toward said support between said first and second portions of said first coupling surface, said inner peripheral surface has a thickness (T2) also extending away from said interior surface of said panel toward said support, and said outer peripheral surface has a thickness (T3) yet also extending away from said interior surface of said panel toward said support, with T1 of said structural adhesive being less than both of T2,T3 of said inner and outer peripheral surfaces such that said first coupling surface is concave relative to said second coupling surface, thereby reducing peak stress of said structural adhesive in said assembly due to the environmental load subjected on the structure as compared to a structural adhesive of the same composition having the same length (L1) and outer peripheral thickness (T1) but having a substantially rectangular cross-section.

19. The assembly as set forth in claim 18 wherein said first portion of said first coupling surface and said inner peripheral surface of said structural adhesive define an acute angle of said substantially concave-polygonal cross-section, said second portion of said first coupling surface and said outer peripheral surface of said structural adhesive define another acute angle of said substantially concave-polygonal cross-section, said second coupling surface and said inner peripheral surface of said structural adhesive define a right angle of said substantially concave-polygonal cross-section, and said second coupling surface and said outer peripheral surface of said structural adhesive define another right angle of said substantially concave-polygonal cross-section.

* * * * *